US005927078A

United States Patent [19]

Watanabe et al.

[11] Patent Number: 5,927,078

[45] Date of Patent: Jul. 27, 1999

[54] THERMOELECTRIC REFRIGERATOR

[75] Inventors: Hideo Watanabe, Kawasaki; Fumikazu Kiya, Noboribetsu, both of Japan

[73] Assignee: Thermovonics Co., Ltd., Kanagawa, Japan

[21] Appl. No.: 08/969,444

[22] Filed: Nov. 13, 1997

[30] Foreign Application Priority Data

Nov. 18, 1996 [JP] Japan ..... 8-306682

[51] Int. Cl.[6] ..... F25B 9/00

[52] U.S. Cl. ..... 62/3.6; 62/3.7

[58] Field of Search ..... 62/3.2, 3.6, 3.62, 62/3.7, 3.5

[56] References Cited

U.S. PATENT DOCUMENTS

| | | | |
|---|---|---|---|
| 4,364,234 | 12/1982 | Reed | 62/3.6 |
| 5,501,076 | 3/1996 | Sharp et al. | 62/3.6 |
| 5,522,216 | 6/1996 | Park et al. | 62/3.6 |
| 5,603,220 | 2/1997 | Seaman | 62/3.7 |
| 5,609,032 | 3/1997 | Bielinski | 62/3.7 |
| 5,655,375 | 8/1997 | Ju | 62/3.6 |
| 5,661,978 | 9/1997 | Holmes | 62/3.6 |

*Primary Examiner*—William Doerrler
*Attorney, Agent, or Firm*—Evenson, McKeown, Edwards & Lenahan, PLLC

[57] ABSTRACT

A thermoelectric refrigerator is provided with a casing formed of a heat-insulating layer, thermal conductors arranged in the casing and having a heat transfer surface located facing a storage space in the casing, a Peltier device thermally connected with the thermal conductors, a device power supply for supplying electric power to the Peltier device, an interior fan for causing interior air to flow in the storage space, a fan power supply for supplying electric power to the interior fan, and a control unit for controlling a quantity of electric power to be supplied to the interior fan in accordance with a quantity of electric power to be supplied to the Peltier device.

5 Claims, 10 Drawing Sheets

THERMOELECTRIC REFRIGERATOR

BACKGROUND OF THE INVENTION a) Field of the Invention

This invention relates to an electric refrigerator for domestic or business use, and specifically to a thermoelectric refrigerator making use of a Peltier device.

b) Description of the Related Art

A conventional electric refrigerator employs a Flon-type refrigerant, and by making use of the latent heat of vaporization of the refrigerant, its refrigerating unit lowers the temperature to −20° C. or lower to cool down the air inside the refrigerator. Accordingly, moisture contained in the air inside the refrigerating unit forms dew and this dew then freezes. Although the air has a relative humidity close to 100% in the vicinity of the refrigerating unit, its humidity becomes very low in an interior region where the temperature is higher than that in the refrigerating unit, for example, 3° C. or so. A lower humidity is preferred for the storage of dried foods, cookies, candies, chocolates and the like in a refrigerator. However, for the storage of perishables, vegetables and the like, a low humidity accelerates a deterioration in freshness so that a low humidity is not a preferred storage atmosphere.

A variety of thermoelectric refrigerators making use of Peltier devices have been proposed recently. They are however accompanied by a drawback. For example, in a cold storage box making use of a Peltier device and having a capacity of from 10 to 15 liters, the interior temperature lowers to −5° C. or lower when the outside temperature drops in winter or the like. As a consequence, the interior humidity becomes low so that the freshness of perishables, vegetables or the like is lowered.

SUMMARY OF THE INVENTION

An object of the present invention is to overcome the above-described drawback of the conventional art and to provide a thermoelectric refrigerator having excellent storage performance without any substantial quality deterioration of foods or the like.

In a first aspect of the present invention, there is thus provided a thermoelectric refrigerator comprising:

a casing formed of a heat-insulating layer;

a thermal conductor arranged in the casing and provided with a heat-conducting surface located opposite a storage space in the casing;

a Peltier device thermally connected with the thermal conductor;

a device power supply for feeding electric power to the Peltier device; and a control unit for controlling a quantity of electric power, which is supplied to the Peltier device, in accordance with temperature variations in the storage space.

In a second aspect of the present invention, there is also provided a thermoelectric refrigerator comprising:

a casing formed of a heat-insulating layer;

a thermal conductor arranged in the casing and provided with a heat-conducting surface located opposite a storage space in the casing;

a Peltier device thermally connected with the thermal conductor;

a device power supply for supplying electric power to the Peltier device;

an interior fan for causing air to flow within the storage space;

a fan power supply for supplying electric power to the interior fan; and a control unit for controlling a quantity of electric power, which is to be supplied to the interior fan, in accordance with a quantity of electric power to the Peltier device.

According to the first aspect of the present invention, the quantity of electric power to the Peltier device is controlled in accordance with temperature variations in the storage space as described above. In the second aspect of the present invention, the arrangement of the control unit, which controls the quantity of electric power to the interior fan in accordance with the quantity of electric power to the Peltier device, as mentioned above has made it possible to perform control in order to increase thermal conductance on a heat-absorbing side when large electric power is supplied to the Peltier device to increase its heat-absorbing ability.

This invention therefore has made it possible to cool down the interior of the refrigerator while maintaining the thermal conductor at a temperature higher than a freezing temperature of water. Accordingly, the interior can be always maintained at a high humidity so that the freshness of perishables, vegetables and the like can be maintained for a long time.

DETAILED DESCRIPTION OF THE INVENTION AND PREFERRED EMBODIMENTS

Figure 1:
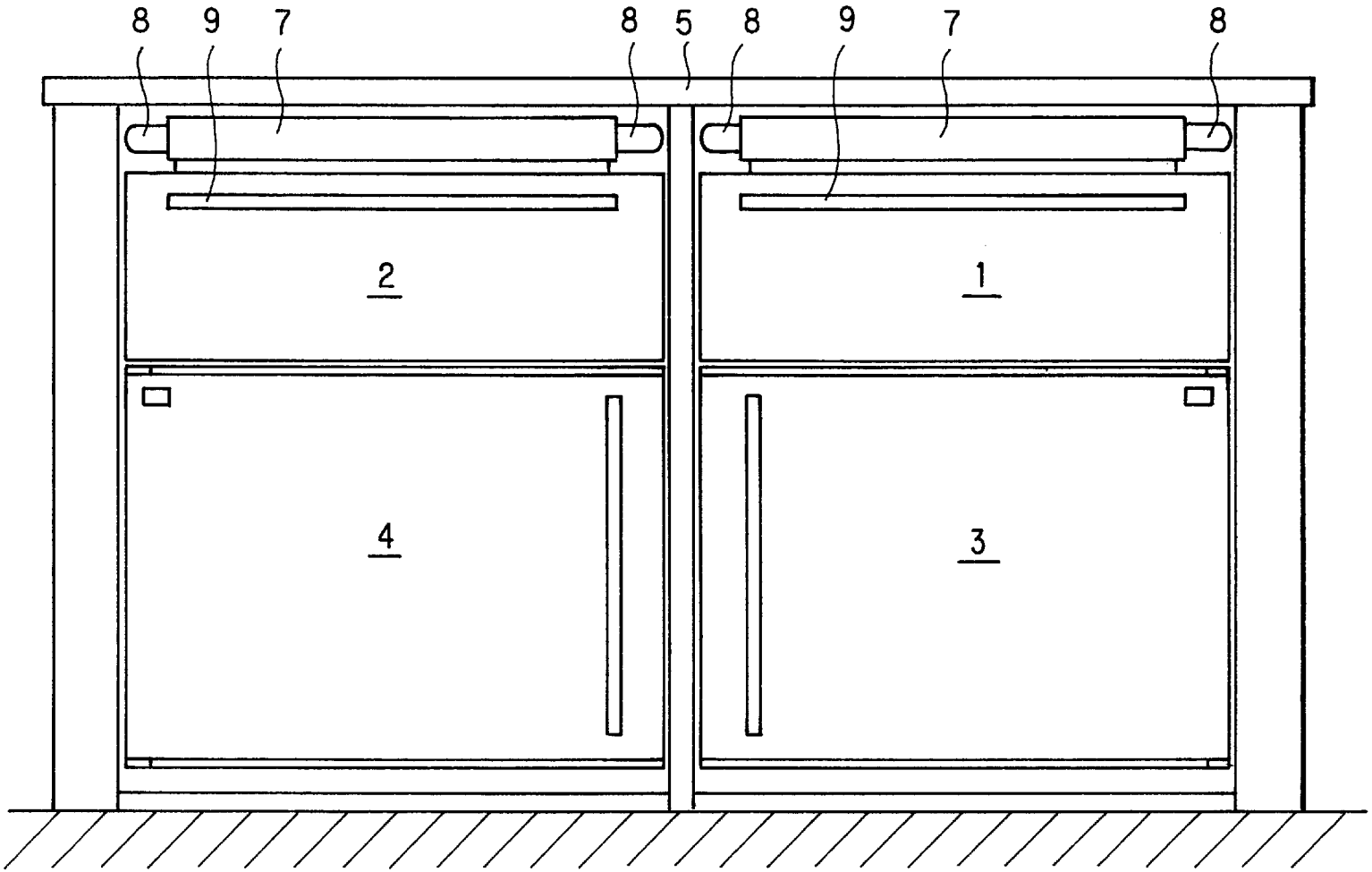
FIG. 1 is a front view of a temperature-controlled appliance according to a first embodiment of the present invention.
Figure 2:
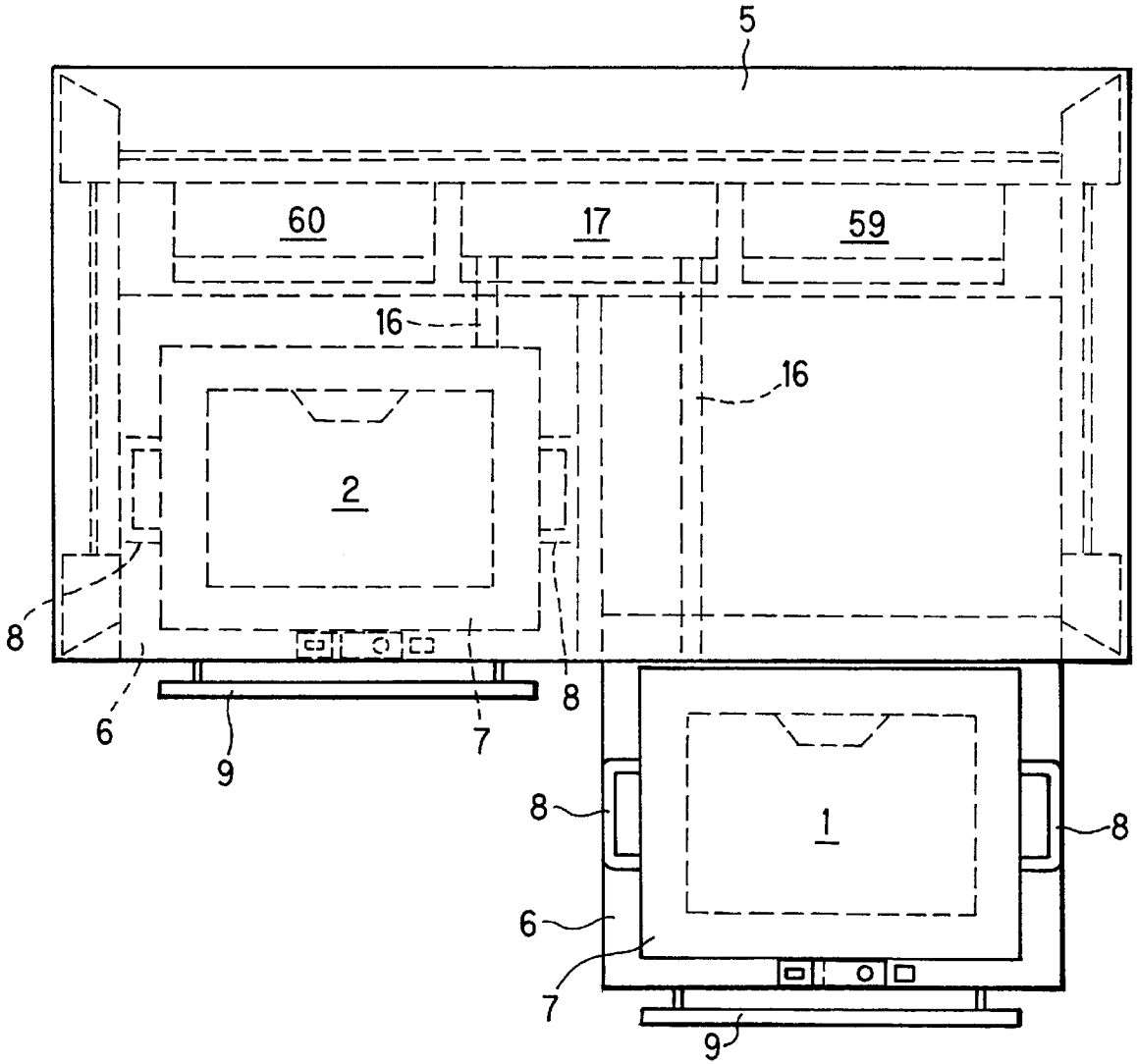
FIG. 2 is a plan view of the temperature-controlled appliance.

The temperature-controlled appliance according to the first embodiment of the present invention will hereinafter be described with reference to FIGS. 1 through 7.

The temperature-controlled appliance according to this embodiment is divided into a quick freezing compartment 1, a defrosting compartment 2, a refrigerated storage compartment 3 and a partial freezing compartment 4. The compartments 1–4 are independently and individually controlled in temperature. The compartments 1–4 are stacked in two stages and are integrally built in a cooling table 5, so that they are of the fixed type.

The quick freezing compartment 1 and the defrosting compartment 2 can be pulled out of the table 5 to facilitate cooking, whereas the refrigerated storage compartment 3 and the partial freezing compartment 4 are built in the table 5.

Figure 3:
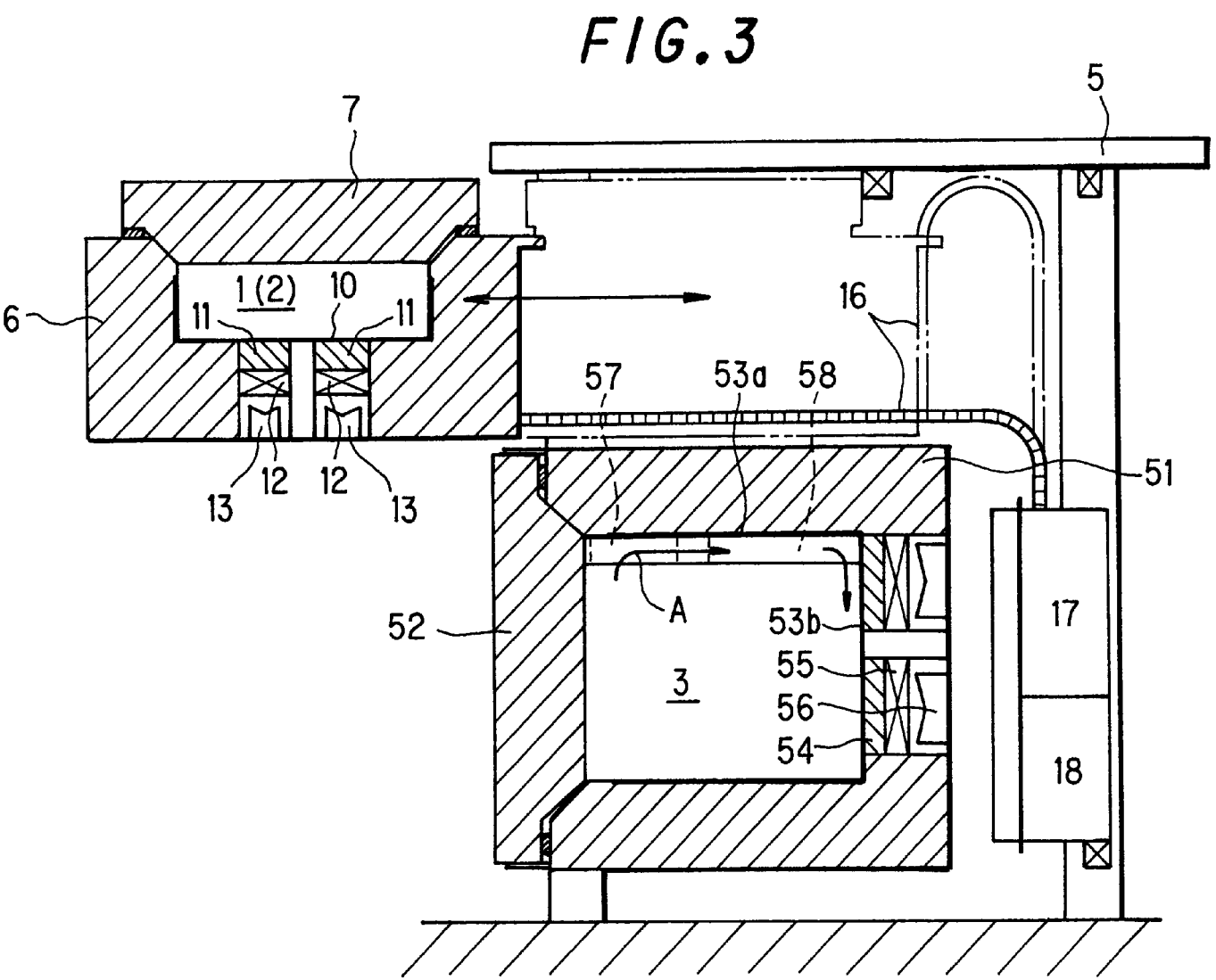
FIG. 3 is a cross-sectional side view of the temperature-controlled appliance.
Figure 4:
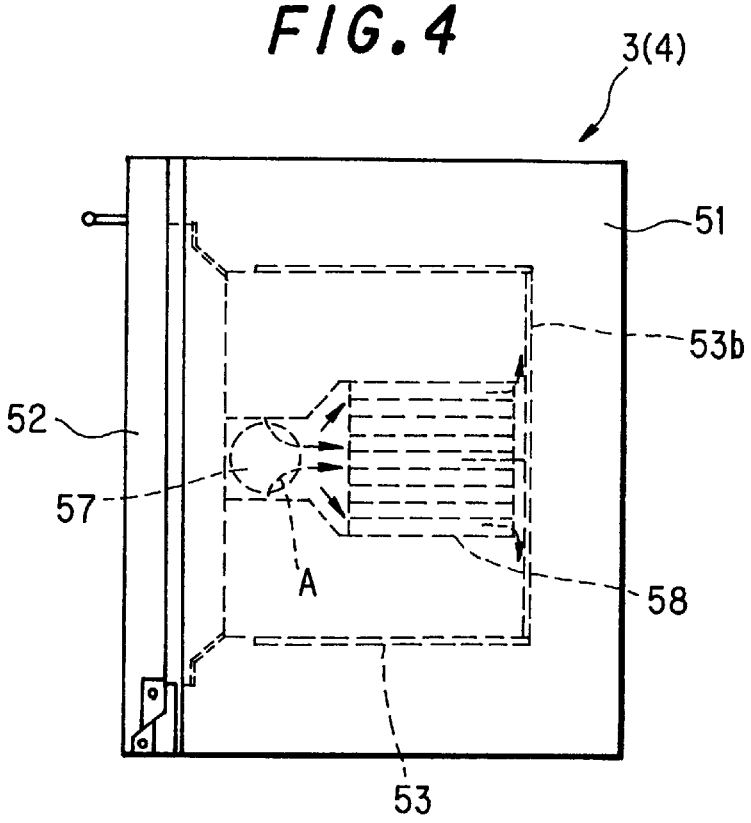
FIG. 4 is a plan view of a refrigerated storage compartment and a partial freezing compartment, both of which constitute the temperature-controlled appliance.
Figure 5:
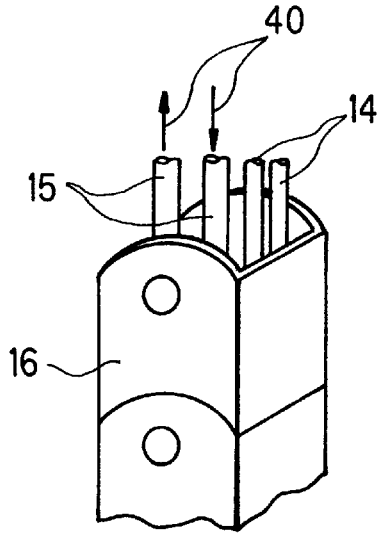
FIG. 5 is a partly-enlarged, perspective view of a cord/hose case used in the temperature-controlled appliance.

As is illustrated in FIG. 3, the quick freezing compartment 1 (the defrosting compartment 2) has a heat-insulating casing 6 in the form of a box opening upward and a heat-insulating cover 7 which operably closes up the opening. The heat-insulating cover 7 are provided at opposite ends thereof with handles 8, and a handle 9 is arranged on a front wall of the heat-insulating casing 6.

As is also shown in FIG. 3, a container-shaped first thermal conductor 10 made, for example, of aluminum or the like is arranged inside the heat-insulating casing 6. On a rear side of a bottom portion of the heat-insulating casing 6, a Peltier device 12 of the cascaded construction is arranged via a second thermal conductor 11 made, for example, of aluminum or the like in the form of plural blocks. Further, a circulation jacket 13 for a heat transfer medium is joined on an outer side of the second thermal conductor 11. Feed cords 14 connected to the Peltier device 12 and hoses 15 connected to the circulation jacket 13 are received in an elongated, flexible cord/hose case 16 (see FIG. 5) and are connected to a second heat-dissipating unit 17 (see FIGS. 2 and 3).

In a state where the freezing compartment 1 has been pulled out of the cooking table 5 as shown in FIG. 3, the cord/hose case 16 is in an extended form. When the freezing compartment 1 is pushed in, the cord/hose case 16 is accommodated in a bent form behind the freezing compartment 1 as indicated by two-dot chain lines. Incidentally, the feed cords 14 are connected to a power supply controller 18 which is arranged near the second heat-dissipating unit 17.

In this embodiment, the freezing compartment 1 and the defrosting compartment 2 are smaller in storage capacity than the refrigerated storage compartment 3 and the partial freezing compartment 4, the hoses 15 of both the compartments 1,2 are connected to only one heat-dissipating unit, that is, the second heat-dissipating unit 17. However, each compartment is provided with its own power supply controller 18. The feed cord 14 connected to the freezing compartment 1 is connected to the freezing power supply controller 18, while the feed cord 14 connected to the defrosting compartment 2 is connected to a defrosting power supply controller (not shown).

Figure 6:
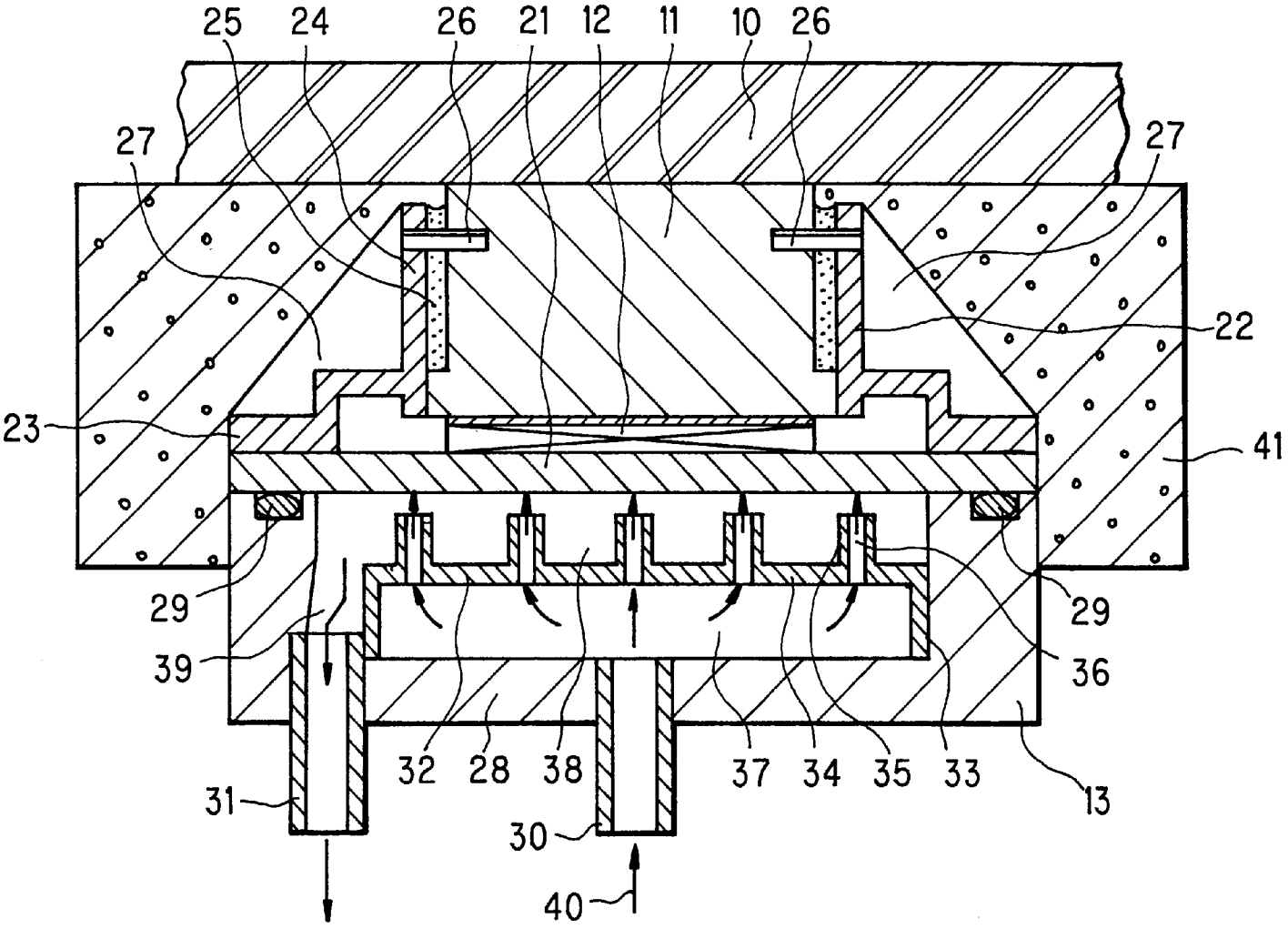
FIG. 6 is an enlarged cross-sectional view of a circulation jacket for a heat transfer medium, which is used in the temperature-controlled appliance.

FIG. 6 illustrates in detail the structure around the circulation jacket 13 for the heat transfer medium. This circulation jacket 13 has a plate-shaped heat-exchanging base 21 joined to a heat-dissipating side of the Peltier device 12. From a peripheral portion of the heat-exchanging base 21, a first frame 22 extends toward the second thermal conductor 11. The first frame 22 is a hollow shape which opens at upper and lower parts thereof, has a basal end portion 23 and an extended portion 22 extending upwards from the basal end portion 23, and has a substantially stepped cross-sectional shape. The basal end portion 23 is joined in a liquid-tight fashion to a peripheral part of an upper surface of the heat-exchanging base 21 by using, for example, an adhesive or an 0-ring and an adhesive in combination.

As is shown in the drawing, the extended portion 24 is located in parallel with and opposite a peripheral wall of the second thermal conductor 11 with an adhesive 25 poured therebetween so that the second conductor 11 and the first frame 22 are integrally joined together.

Plural positioning pins 82 extend across the peripheral wall of the second thermal conductor 11 and the extended portion 24 to prevent any relative positional displacement between the second thermal conductor 11 and the first frame 22 before the adhesive 25 hardens completely. The extended portion 24 is provided on an outer side thereof with plural (four in this embodiment) reinforcing ribs 27 which extend toward the basal end portion 23, whereby the first frame 22 is allowed to remain rigid.

Further, the stepwise, in other words, nonlinear configuration between the basal end portion 23 and the extended portion 24 surely provides the first frame 22 with a longer creeping distance from the second thermal conductor 11 of the first frame 22 to the heat-exchanging base 21, thereby reducing a quantity of heat to be returned through the first frame 22.

On a peripheral part of a lower side of the heat-exchanging base 21, a second frame 28 having a hollow shape which is substantially closed at a lower part thereof but is open at an upper part thereof is bonded in a liquid-tight fashion with an O-ring 29 interposed therebetween. The second frame 28 is provided at an approximately central part thereof with a supply pipe 30 and near a peripheral edge thereof with a drain pipe 31.

A distributing member 32, which is arranged in the hollow space of the second frame 28, is provided with a peripheral wall 33, an upper wall 34 disposed in continuation to an upper edge of the peripheral wall 33, and a number of nozzle portions 35 extending from the upper wall 34 toward the heat-exchanging base 21. Through the nozzle portions 35, spray nozzles 36 are formed, respectively.

By fixing the distributing member 32 within the second frame 28, a flattened first space 37 is formed on a side of the supply pipe 30 relative to the distributing member 32 and a flattened second space 38 is formed on a side of the heat-exchanging base 21 relative to the distributing member 32. Further, a drain channel 39 is formed communicating the second space 38 with the drain pipe 31.

As is depicted in the drawing, when the heat transfer medium 40 formed of purified water, antifreeze or the like (purified water is used in this embodiment) is supplied through the central supply pipe 30, it immediately spreads out in the first space 37 and vigorously jets out from the individual nozzle portion 35 (spray nozzles 36) toward the lower side of the heat-exchanging base 21 in substantially a perpendicular direction. The heat transfer medium 40 hits the heat-exchanging base 21 and absorbs heat therefrom. It then promptly spreads out in the narrow second space 38 and flows out of the system through the drain channel 39 and the drain pipe 31. The thus-drained heat transfer medium 40 flows though the hoses 15 shown in FIG. 5. It is then subjected to forced cooling in a radiator (not shown) arranged in the second heat-dissipating unit 17 illustrated in FIG. 3 and is then supplied again to the circulation jacket 13 by an unillustrated pump. In FIG. 6, numeral 41 indicates a heat-insulating material layer filled around the circulation jacket 13 for the heat transfer medium.

The refrigerated storage compartment 3 (the partial freezing compartment 4) has a heat-insulating casing 51 in the form of a box which is open through a front wall. A heat-insulating door 52 is arranged to operably close the opening in the front wall. In close contact with an inner wall of the heat-insulating casing 51, a container-shaped first thermal conductor 48 is arranged. A block-shaped second thermal conductor 54 is disposed on a rear side of a substantially central part of a wall portion of the first thermal conductor 53, said wall portion being located opposite the opening, in other words, an end wall portion of the first thermal conductor 53. On a rear side of the second thermal conductor 54, a circulation jacket 5 for the heat transfer medium is arranged via a Peltier device 55 of the cascaded construction.

The construction and function of the circulation jacket 56 for the heat transfer medium are similar to those described above with reference to FIG. 6, and their description is therefore omitted herein.

To cause interior air A (see FIG. 3 and FIG. 4), which exists inside the refrigerated storage compartment 3, to flow along an upper peripheral wall 53*a* of the first thermal conductor 53, to hit an end wall 53*b* in which the Peltier device 55 is arranged and then to flow down along the end wall 53*b* as indicated by arrows, the upper peripheral wall 53*a* is provided on an inner side thereof with an interior fan 57 and a number of heat-absorbing fins 58 having guide grooves extending in parallel with each other. In addition, the upper peripheral wall 53*a* and the end wall 53*b* are slightly thicker than the remaining walls of the first thermal conductor 53.

Owing to such functions of the interior fan 57 and the heat-absorbing fins 58 provided with the guide grooves, a high cooling efficiency is obtained when the interior air A is caused to flow from the upper peripheral wall 53*a* and long a surface of the end wall 53*b*.

In this embodiment, the quick freezing compartment 1 and the defrosting compartments 2 are used to freeze and defrost only necessary items, and the capacities of both the compartments 1,2 are relatively small, for example, about 7 liters each. In contrast, the refrigerated storage compartment 3 and the partial freezing compartment 4 are used for storage so that the capacities of both the compartments 3,4 are relatively large, for example, about 30 liters each. Since the capacities of both the compartments 3,4 are large and strict control of their interior temperatures is needed to maintain constant the quality of the stored foods and the like, the refrigerated storage compartment 3 and the partial freezing compartments 4 are provided with their own heat-dissipating units, namely, the first heat-dissipating unit 59 and the third heat-dissipating unit 60, respectively, to reduce external disturbances as much as possible.

Figure 7:
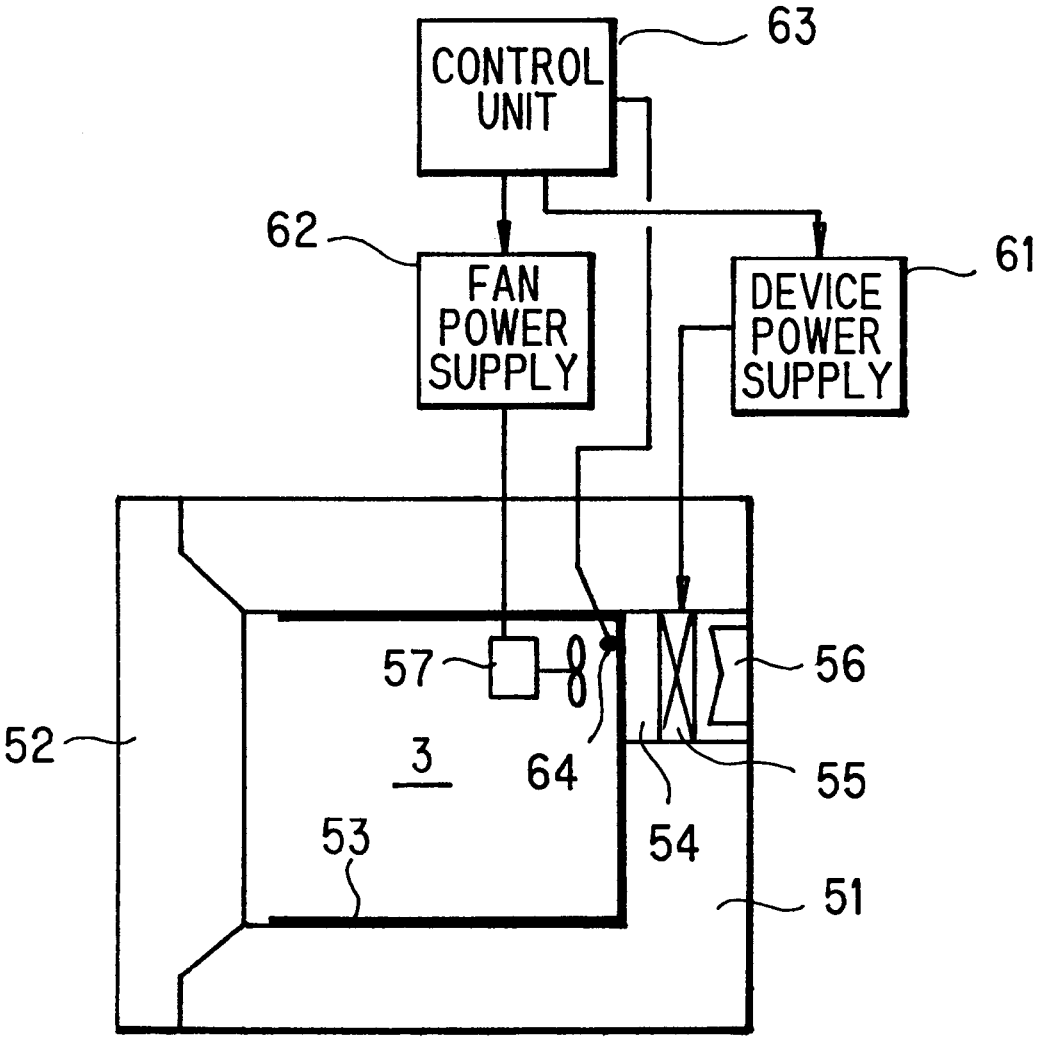
FIG. 7 is a simplified block diagram for describing humidity control of the refrigerated storage compartment.

As is depicted in FIG. 7, the Peltier device 55 is driven by electric power supplied from a device power supply 61, while the interior fan 57 is driven by electric power supplied from a fan power supply 62. These device power supply 61 and fan power supply 62 are controlled by signals from a control unit 63. Further, the first thermal conductor is provided on a surface thereof with a temperature sensor 64 in the vicinity of a position where the Peltier device 55 is arranged. Detection signals from the temperature sensor are inputted in the control unit 63.

When the heat-insulating door 52 of the refrigerated storage compartment 3 is opened or an item to be refrigerated, such as a food, is placed in the refrigerated storage compartment, the interior temperature rises rapidly. This temperature rise is detected by the temperature sensor 64, and based on a detection signal from the temperature sensor, the control unit 63 supplies a large quantity of electric power to the Peltier device 55 by way of the device power supply 61.

As a consequence, the temperature of the first thermal conductor 53 especially in the vicinity of the position where the Peltier device 55 is arranged. The first thermal conductor hence begins to drop toward a temperature at which water freezes or lower. Accordingly, while monitoring detection signals from the temperature sensor 64, the electric power to the interior fan 57 is increased at a time point shortly before the temperature of the first thermal conductor drops to a water-freezing temperature. As a result, the linear velocity of the interior air A increases, leading to a higher thermal conductance at the first thermal conductor 53. Freezing of water on the surface of the first thermal conductor 53 is therefore avoided, thereby making it possible to maintain the interior humidity high.

Incidentally, the high-speed rotation of the interior fan 57 can be either continuous or intermittent. However, rotation of the interior fan at a high speed for an unduly long time result in wasting of electric power and also in deleterious effects on the storage of vegetables or the like. It is therefore necessary to set such a control mode that the time of high-speed rotation is limited to such an extent as permitting maintenance of the temperature and humidity at desired values and the rated operation can then be performed again.

The following specific example can be mentioned.

Interior capacity: 30 liters.

Heat-insulating material: Two-components, non-flon type expanded resin; thickness: 80 mm.

Peltier device: 142 semiconductor chips are used. Each chip is in a square form of 1.4 mm per side. Two-stage cascaded structure. 6 sets are mounted.

Heat-absorbing system: A first thermal conductor made of aluminum is provided with an interior fan and heat-absorbing fins. Voltage for the interior fan: 6 to 12 V (rated voltage: 6V).

Heat-dissipating system: Recirculation type making use of purified water as a heat transfer medium. Final dissipation of heat is performed by dissipating heat into the open air through a radiator.

A predetermined quantity of vegetables were placed in the refrigerated storage compartment, electric power of 25 W was supplied to the Peltier device, and the rated voltage of 6 V was applied across the interior fan to cause a gentle flow of the interior air. At this time, the average interior temperature (an average of temperatures measured at 10 locations) was 3.5° C., the surface temperature of the first thermal conductor in the vicinity of the Peltier device was 1.0° C., and the interior relative humidity (RH) was 80%. The refrigerated storage compartment was therefore under conditions suited for the refrigerated storage of the vegetables.

By repeatedly opening and closing the heat-insulating door five times in the above state, the average interior temperature was caused to rise to 15° C. The electric power to be supplied the Peltier was then increased to 100 W (increment: 400%) to lower the interior temperature. When the interior fan was operated while the rated voltage was maintained (as in the conventional art), the average interior temperature dropped to 3.5° C. upon an elapsed time of 20 minutes after the opening and closing of the door. However, the surface temperature of the first thermal conductor in the vicinity of the Peltier device was 1.0° C., and a thin layer of ice was formed on the surface of the first thermal conductor. The interior relative humidity (RH) at a location apart from the first thermal conductor had dropped to 50%. The refrigerated storage compartment was therefore under humidity conditions unsuited for the refrigerated storage of the vegetables.

When, as described above, the electric power to be supplied to the Peltier device was increased and the voltage to be applied across the interior fan was raised from 6 V to 12 V (as in the present invention), on the other hand, the linear velocity of the interior art became higher, and the interior air hit the first thermal conductor so that the thermal conductance increased on the heat-absorbing side. As a result, the average interior temperature and the surface temperature of the first thermal conductor in the vicinity of the Peltier device dropped to 3.5° C. and 0.5° C., respectively, upon an elapsed time of 12 minutes after the opening and closing of the door. However, the interior relative humidity (RH) was as high as 80% so that conditions suited for the refrigerated storage of the vegetables was successfully maintained.

The thermoelectric refrigerator according to the second embodiment of the present invention will next be described with reference to FIG. 8 through FIG. 10.

Figure 8:
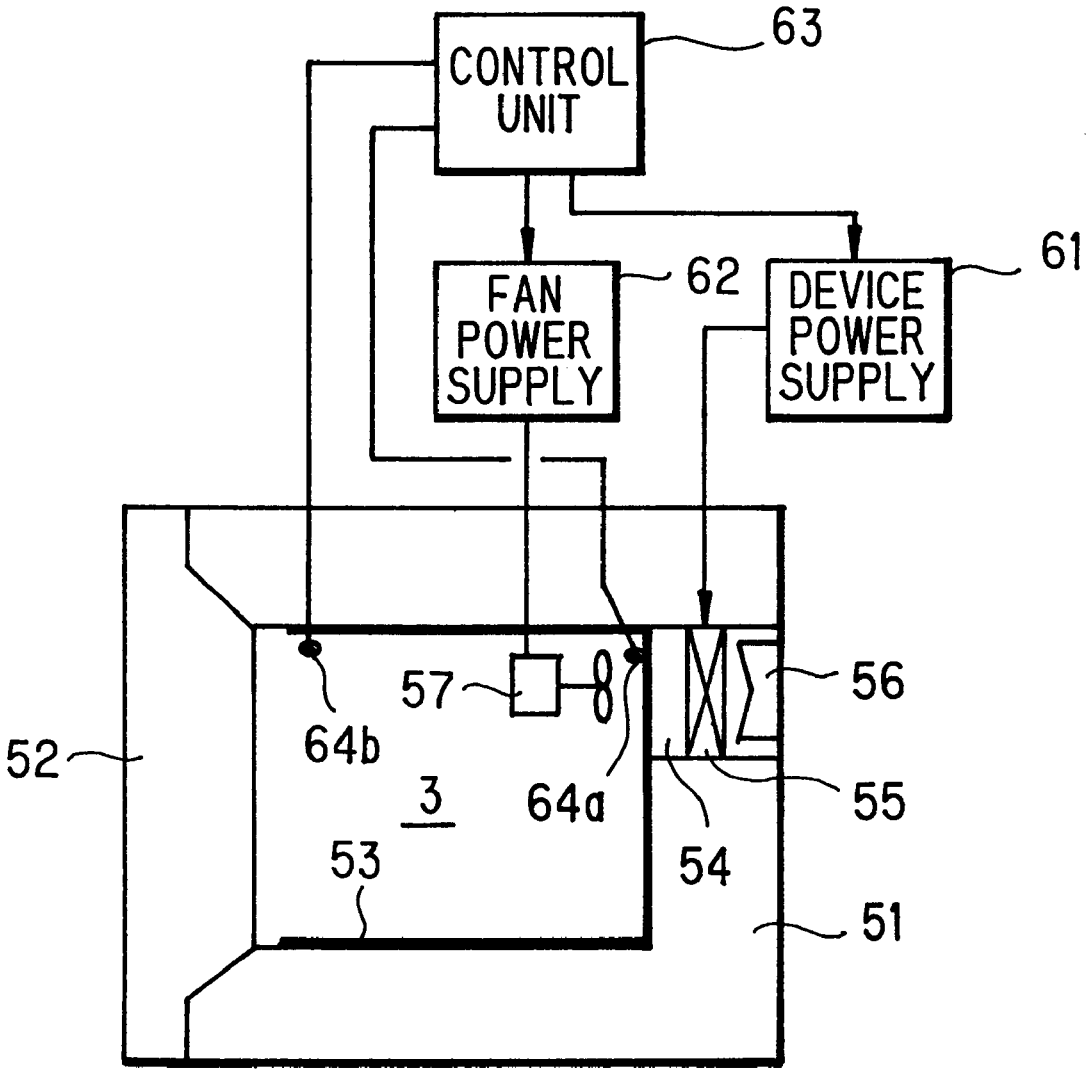
FIG. 8 is a simplified block diagram for describing humidity control of a refrigerated storage compartment according to a second embodiment of the present invention.
Figure 9:
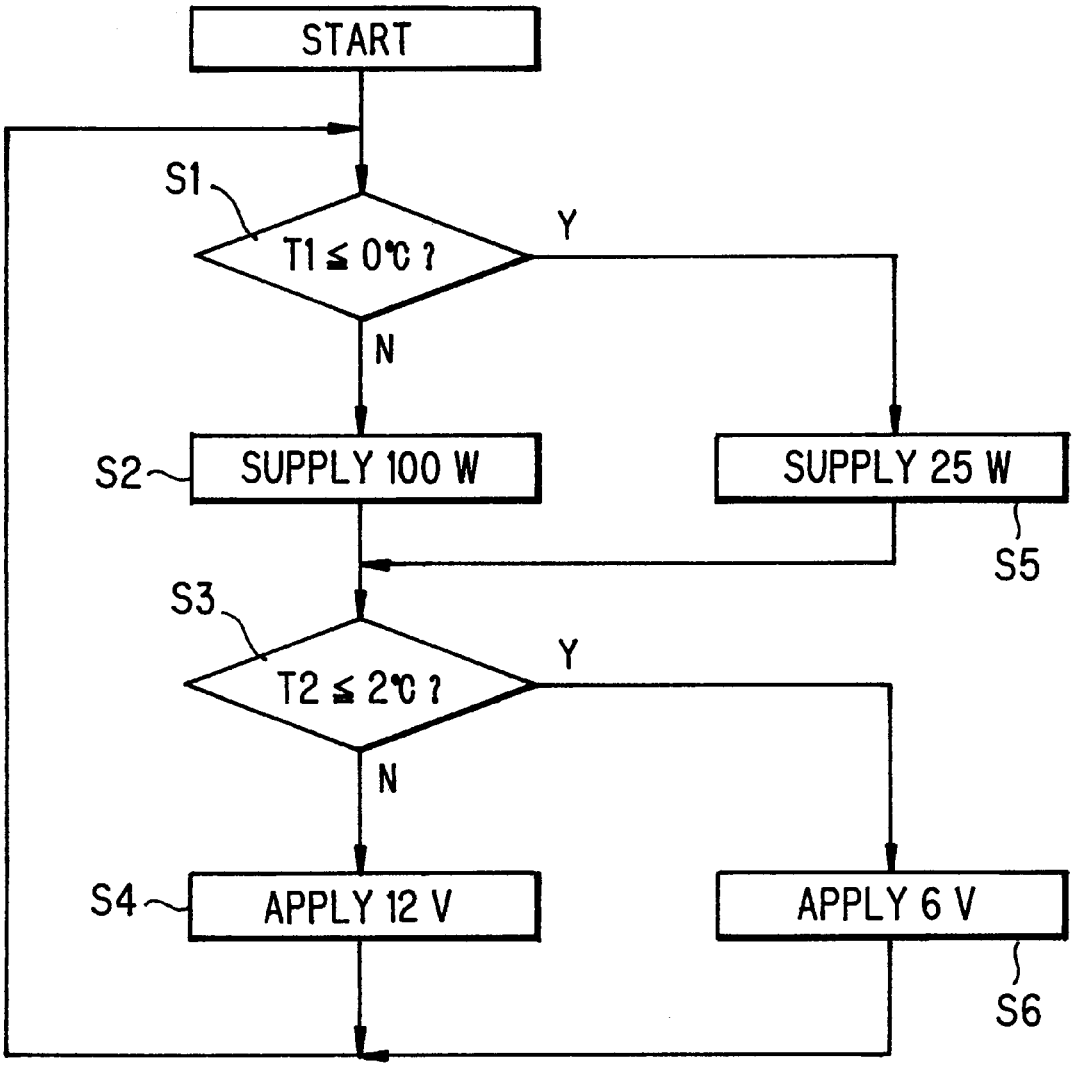
FIG. 9 is a flow chart for performing the humidity control of the refrigerated storage compartment according to the second embodiment of the present invention.

As is illustrated in FIG. 8, a first temperature sensor 64*a* is arranged on a surface of a first thermal conductor 53 in the vicinity of a position where the Peltier device 55 is arranged (this is similar to the first embodiment), a second temperature sensor 64*b* is disposed at an interior position apart from the first temperature sensor 64*a* (near the heat-insulating door 52 in this embodiment), and detection signals of the first temperature sensor 64*a* and second temperature sensor 64*b* are inputted to a control unit 63.

At the control unit 63, a first threshold temperature for detection signals of the first temperature sensor 64*a* and a second threshold temperature for detection signals of the second temperature sensor 64*b* have been set beforehand at 0° C. and 2° C., respectively. Further, the control unit 63 is designed so that electric power to be supplied to the Peltier device 55 can be switched between 25 W and 100 W at a device power supply 61 and a voltage to be applied across an interior fan 57 can be switched between 6 V and 12 V at a fan power supply 62.

A description will next be made about humidity control. As is illustrated in FIG. 9, the control unit 63 determines in step (hereinafter abbreviated as "S") 1 whether or not a first detection temperature T1 detected at the first temperature sensor 64*a* is not higher than 0° C. If T1 is not found to have already dropped to 0° C., the routine then advances to S2 and the electric power applied from the device power supply 61 is maintained at the high level, namely, at 100 W to promote cooling of the interior of the refrigerated storage compartment.

The routine again returns to a stage preceding S1. If T1 is not determined to be higher than 0° C., the electric power to be supplied from the device power supply 61 is lowered to 25 W in S5 to maintain the interior temperature at the first threshold temperature, and the routine then advances to S3. If T2 is not determined to be higher than 2° C. in S3, the voltage to be applied across the fan power supply 62 is lowered to 6 V in S6 to make a flow of the interior air gentler. Repetition of such a routine makes it possible to keep the relative humidity (RH) of the whole interior at a level as high as 80% and hence to maintain the interior under conditions suited for the refrigerated storage of vegetables.

Incidentally, the switching of electric power from the device power supply 61 and the switching of the voltage applied from the fan power supply 62 are performed by the control unit 63.

Figure 10:
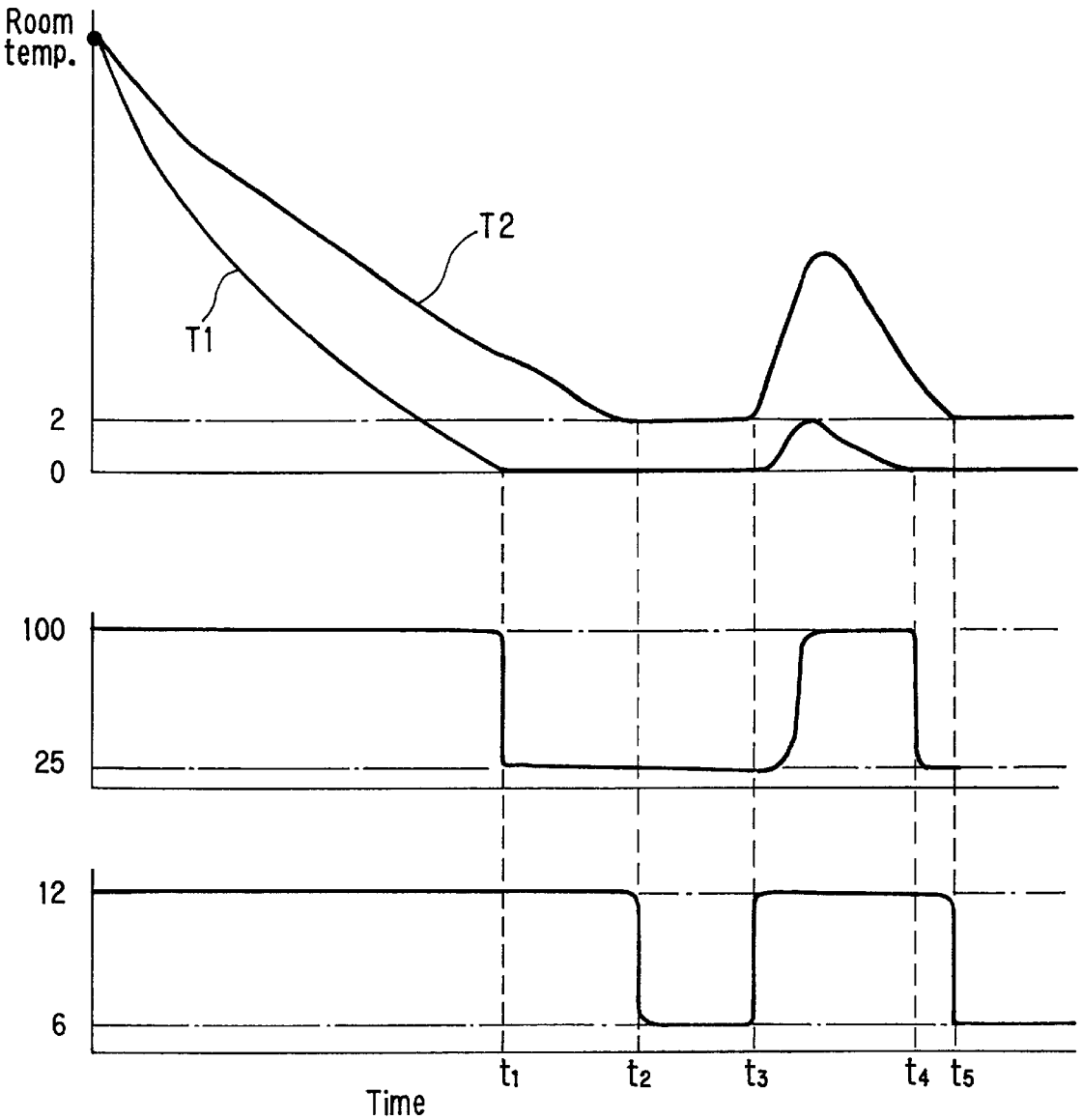
FIG. 10 is a timing chart for performing the humidity control of the refrigerated storage compartment according to the second embodiment of the present invention.

The timing chart of FIG. 10 illustrates the state of variations in the interior temperature, the manner of switching of the electric power to be supplied to the Peltier device and the manner of switching of the voltage applied across the interior fan, all for the humidity control of the interior of the refrigerated storage compartment. In the chart, T1 represents first detection temperatures detected by the first temperature sensor 64*a*, and T2 represents second detection temperatures detected by the second temperature sensor 64*b*.

The abscissa of the chart indicates an elapsed time. In the chart, t1 designates a time point at which the first detection temperature T1 has dropped to the first threshold temperature, i.e., 0° C. and the electric power to be supplied to the Peltier device has been switched from 100 W to 25 W, and t2 indicates a time point at which the second detection temperature T2 has dropped to the second threshold temperature, i.e., 2° C. and the voltage to be applied across the interior fan has been switched from 12 V to 6 V. The Peltier device and the interior fan are driven fully until the first detection temperature T1 and the second detection temperature T2 drop to their respective threshold temperatures.

t3 designates a time point at which the heat-insulating door of the refrigerated storage compartment is subsequently opened. As a result of this door opening, the first detection temperature T1 and the second detection temperature T2 rise and in particular, the second detection temperature T2 in the vicinity of the heat-insulating door rises rapidly. Upon detection of this temperature rise, the Peltier device and the interior fan are fully driven to promptly lower the interior temperature. Further, t4 indicates a time point at which the first detection temperature T1 has subsequently dropped to 0° C. again, and t5 designates a time point at which the second detection temperature T2 has subsequently dropped to 2° C. again.

In the above-described second embodiment, one threshold temperature was set for each temperature sensor and, when the threshold temperatures were reached, the supplied electric power and the applied voltage were each switched between two stages, for example, from 100 W to 25 W and from 12 V to 6 V, respectively. However, the supplied electric power and the applied voltage can be changed over plural stages or in a stepless manner around a target temperature of the control (for example, a range of from 1 to 0° C. in the case of the first threshold temperature or a range of from 3 to 10° C. in the case of the second threshold temperature).

Figure 11:
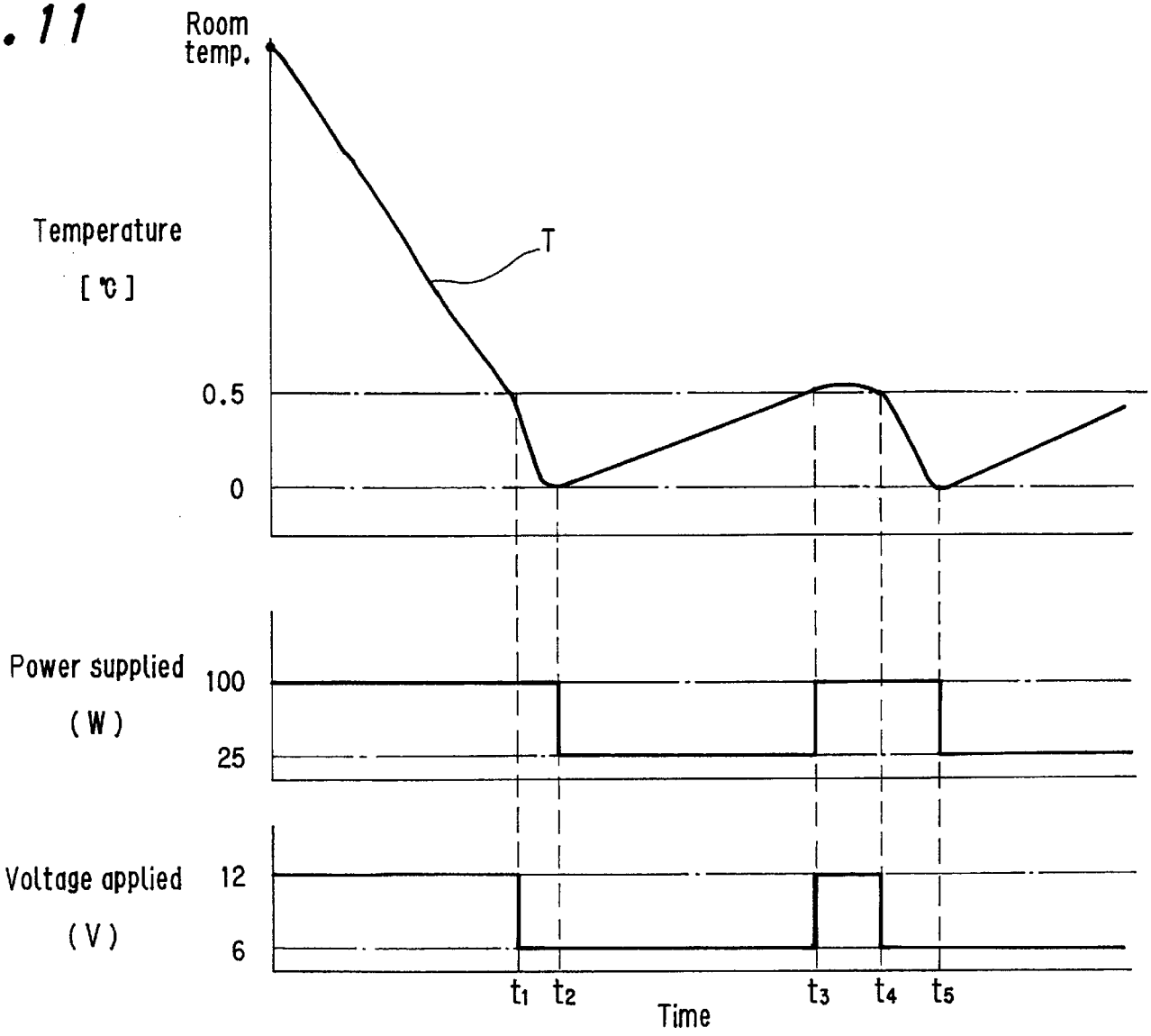
FIG. 11 is a timing chart for describing a refrigerated storage compartment according to a third embodiment of the present invention.

With reference to the timing chart of FIG. 11, the third embodiment of the present invention will hereinafter be described. In this embodiment, an approximate construction for temperature control is similar to that illustrated in FIG. 7 and is equipped with a device power supply 61, a fan power supply 62, a control unit 63, and a single temperature sensor 64. At the control unit 63, 0.5° C. and 0° C. have been set as a first threshold and a second threshold, respectively (the first threshold>the second threshold). Further, the control unit 63 is designed so that electric power to be supplied to a Peltier device can be switched between 25 W and 100 W and a voltage to be applied across an interior fan 57 can be switched between 6 V and 12 V.

Until the detection temperature T of the temperature sensor 64 drops to 0.5° C., the electric power to be supplied from the device power supply 61 is set at 100 W to perform thermoelectric cooling and the voltage to be applied from the fan power supply 62 is maintained at 12 V to allow the interior air to spread thoroughly, whereby cooling of the whole interior is promoted.

At a time point t1 where the detection temperature T of the temperature sensor 64 has dropped to the first threshold, namely, 0.5° C., the voltage applied from the fan power supply 62 is lowered from 12 V to 6 V while maintaining at 100 W the power to be supplied from the device power supply 61. When the detection temperature T drops to the second threshold, i.e., 0° C. (t2), the electric power to be supplied from the device power supply 61 is switched from 100 W to 25 W while maintaining at 6 V the voltage to be applied from the fan power supply 62.

t3 indicates a time point at which as a result of the reduction of the power supplied to the Peltier device, the interior temperature has then risen and the detection temperature T has exceeded 0.5° C. At this time point, the Peltier device and the interior fan are fully driven (electric power supplied from the device power supply 61: 100 W, voltage applied from the fan power supply 62: 12 V) to promptly lower the interior temperature. When the interior temperature drops to 0.5° C. (t4), the voltage to be applied from the fan power supply 62 is switched from 12 V to 6 V while maintaining at 100 W the electric power to be applied from the device power supply 61. When the temperature drops further to 0° C. (t5), the electric power to be supplied from the device power supply 61 is reduced to 25 W. In this embodiment, the drive control of the Peltier device and interior fan is performed by using the single temperature sensor 64 as described above.

Incidentally, the lower level of the voltage applied across the interior fan 57 was set at 6 V in this embodiment. It may however be set at 0 V. Between the first threshold and the second threshold, the electric power to the Peltier device and the voltage to the interior fan were each switched between two stages in this embodiment. Between the first threshold and the second threshold, they can each be changed over plural stages or in a stepless manner.

In each of the above-described embodiments, the interior fan was used. The interior fan is however not absolutely needed. Spinach was confirmed to remain as was without wilt and to retain freshness even an elapsed time of 24 hours by storing the spinach in the refrigerated storage compartment without using any interior while maintaining the interior humidity at 95 to 98%.

As a still further embodiment of the present invention, the interior of a casing or a storage compartment for perishables such as vegetables can be maintained at a high humidity by arranging water-retaining means for holding water and permitting its evaporation, such as a recessed portion, a container or a water-retaining material like sponge, and allowing the water to evaporate from the water-retaining means. As an alternative, a humidifier unit making use of ultrasonic waves or the like can be arranged to maintain the interior of the casing or storage compartment at a desired high humidity.

What is claimed is:

1. A thermoelectric refrigerator, comprising:

a casing formed of a heat-insulating layer;

a thermal conductor arranged in said casing and provided with a heat-conducting surface located opposite a storage space in said casing;

a Peltier device thermally connected with said thermal conductor;

a device power supply for supplying electric power to said Peltier device;

an interior fan for causing air to flow within said storage space;

a fan power supply for supplying electric power to said interior fan;

a control unit for controlling a quantity of electric power, which is to be supplied to said interior fan, in accordance with a quantity of electric power to said Peltier device;

a first temperature sensor for detecting a surface temperature of said thermal conductor around a position where said thermal conductor is joined with said Peltier device; and a second temperature sensor for detecting an interior temperature at a position remote from said first temperature sensor;

wherein said control unit can change electric power to be supplied from said device power supply and a voltage to be applied from said fan power supply, and said change of said electric power from said device power supply is performed based on a detection temperature of said first temperature sensor, and said change of said voltage from said fan power supply is conducted based on a detection temperature of said second temperature sensor.

2. A thermoelectric refrigerator, comprising:

a casing formed of a heat-insulating layer;

a thermal conductor arranged in said casing and provided with a heat-conducting surface located opposite a storage space in said casing;

a Peltier device thermally connected with said thermal conductor;

a device power supply for supplying electric power to said Peltier device;

an interior fan for causing air to flow within said storage space;

a fan power supply for supplying electric power to said interior fan;

a control unit for controlling a quantity of electric power, which is to be supplied to said interior fan, in accordance with a quantity of electric power to said Peltier device;

a temperature sensor for detecting an interior temperature;

wherein at said control unit, a first temperature threshold and a second temperature threshold lower than said first temperature threshold have been set for changing a quantity of electric power from said fan power supply unit and for changing a quantity of electric power from said device power supply, respectively;

said control unit maintains said quantities of electric power from said fan power supply and said device power supply at large values until an interior temperature detected by said temperature sensor drops to said first temperature threshold, said control unit sets said quantity of electric power from said fan power supply at a small value and said quantity of electric power from said device power supply at a large value when a detected interior temperature has dropped to said first temperature threshold, and said control unit maintains said quantities of electric power from said fan power supply and said device power supply at large values after a detected interior temperature has dropped said second temperature threshold.

3. A thermoelectric refrigerator according to claim 1, wherein said control unit controls said quantity of electric power so that a temperature of a surface of said thermal conductor, said surface being exposed to said storage space of said casing, remains above a temperature at which water freezes.

4. A thermoelectric refrigerator according to claim 2, wherein said interior fan is arranged to blow interior air against said thermal conductor around a position where said thermal conductor is joined with said Peltier device.

5. A thermoelectric refrigerator according to claim 2, wherein said control unit controls said quantity of electric power so that a temperature of a surface of said thermal conductor, said surface being exposed to said storage space of said casing, remains above a temperature at which water freezes.

* * * * *